US005513565A

United States Patent [19]

Hasegawa

[11] Patent Number: 5,513,565

[45] Date of Patent: May 7, 1996

[54] STENCIL PRINTING DEVICE, AND ASSEMBLY FOR SUPPORTING A PLURALITY OF PRINTING DRUMS

[75] Inventor: Takanori Hasegawa, Tokyo, Japan

[73] Assignee: Riso Kagaku Corporation, Tokyo, Japan

[21] Appl. No.: 337,364

[22] Filed: Nov. 8, 1994

[30] Foreign Application Priority Data

Nov. 18, 1993 [JP] Japan ..... 5-288937

[51] Int. Cl.[6] ..... B41F 15/10

[52] U.S. Cl. ..... 101/116; 101/115

[58] Field of Search ..... 101/114, 115, 101/116–119, 128.4, 129, 136, 174, 216

[56] References Cited

U.S. PATENT DOCUMENTS 5,099,758 3/1992 Hassler et al. ..... 101/115
5,375,516 12/1994 Hasegawa ..... 101/116

FOREIGN PATENT DOCUMENTS 459595 12/1991 European Pat. Off. .
607699 7/1994 European Pat. Off. .
2121700 2/1972 Germany .
15739 3/1992 Japan .

*Primary Examiner*—Stephen Funk
*Attorney, Agent, or Firm*—Dickstein, Shapiro & Morin

[57] ABSTRACT

In a stencil printing device, a plurality of printing drums are mounted on a turret-like printing drum supporting member, and the indexing rotary movement of the printing drum supporting member and the rotary actuation of each of the printing drums thereon are effected by a common motor without regard to the number of the printing drums so that the overall structure can be simplified, and the control of the indexing rotary movement of the planetary plate disk and the rotary actuation of each of the printing drums can be accomplished in a centralized manner. The present invention is particularly useful in a stencil printing for full color printing.

13 Claims, 10 Drawing Sheets

STENCIL PRINTING DEVICE, AND ASSEMBLY FOR SUPPORTING A PLURALITY OF PRINTING DRUMS

TECHNICAL FIELD

The present invention relates to a stencil printing device, and an assembly for supporting a plurality of printing drums for rotative actuation thereof in a stencil printing device.

BACKGROUND OF THE INVENTION

According to a previously proposed multi printing drum stencil printing device which is disclosed in Japanese patent publication for opposition purpose (kokoku) No. 04-15739, a plurality of printing drums are mounted on a planetary disk (printing drum supporting member) which is adapted to be rotated around its center of rotation, with each printing drum adapted to be rotated around a central axial line thereof, and each of the printing drums is selectively brought to a stencil printing position opposing a press roller by the indexing action of the planetary disk.

According to this multi printing drum stencil printing device, by using a printing ink of a different color for each of the printing drums, a stencil printing of a desired color, a multi color stencil printing or a full color stencil printing using the colors of cyan, magenta, yellow and black can be accomplished by the indexing action of the planetary disk without involving the need for replacing the printing drums.

According to such a conventional multi printing drum stencil printing device, the indexing movement of the planetary disk and the rotative actuation of the printing drums were effected by separate electric motors, and the number of necessary electric motors was equal to the number of the printing drums plus one. Therefore, five electric motors were necessary when there were four printing drums for full color printing. This is highly detrimental to the compact and light weight design of the stencil printing device, and also contributes to the increase in the cost.

Furthermore, these motors were required to be individually controlled, and not only the mechanical structure but also the control system tended to be highly complex. Also, the efforts and cost required for maintenance were also substantial.

BRIEF SUMMARY OF THE INVENTION

In view of such problems of the prior art, a primary object of the present invention is to provide a stencil printing device which is provided with a plurality of printing drums but is highly compact in design.

A second object of the present invention is to provide a stencil printing device which is capable of multi color printing in a highly automated fashion in a highly reliable manner.

A third object of the present invention is to provide a stencil printing device which is provided with a plurality of printing drums but is highly simple in the control structure thereof.

A fourth object of the present invention is to provide an assembly for supporting a plurality of printing drums in such a stencil printing device.

These and other objects of the present invention can be accomplished by providing an assembly for supporting a plurality of printing drums for rotative actuation thereof in a multi printing drum stencil printing device, comprising: a printing drum supporting member rotatably supported by a fixed frame around a central axial line of the printing drum supporting member; a plurality of cylindrical printing drums each adapted to have a stencil master plate sheet mounted around an outer circumferential surface thereof and mounted on the printing drum supporting member so as to be rotatable around an axial line parallel to the central axial line of the printing drum supporting member; a rotary actuator mounted on the printing drum supporting member; power transmitting means adapted to selectively and individually engage each of the printing drums with an output shaft of the rotary actuator; and printing drum supporting member driving means for effecting an indexing rotary motion of the printing drum supporting member.

According to such a structure, the plurality of printing drums mounted on the printing drum supporting member can be rotatively actuated by the common rotary actuator in a selective manner according to the engagement condition of the power transmitting means, and the assembly can be simplified in structure, and reduced in size.

If the printing drum supporting member driving means comprises output shaft securing means for selectively securing an output shaft of the rotary actuator so as to effect the indexing rotary motion of the printing drum supporting member with a reaction force produced by the rotary actuator when the output shaft thereof is secured by the output shaft securing means, the rotary actuator can be used for actuating not only each of the printing drums but also the printing drum supporting member so that the advantages of the present invention can be further enhanced. Typically, the power transmitting means comprises clutches for selectively transmitting an output torque of the rotary actuator to a selected one of the printing drums, and brakes for securing those of the printing drums that are not selected to be actuated.

According to a preferred embodiment of the present invention, the printing drum supporting member may consist of a rotary turret which supports the printing drums on a circle concentric to the central axial line thereof, and the rotary actuator which typically consists of an electric motor in a central part thereof.

If desired, a second rotary actuator mounted on the fixed frame may be used for effecting the rotary indexing motion of the printing drum supporting member.

To ensure reliable operation of the assembly of the present invention, it is preferable to securely fix the printing drum supporting member at each of its indexing angular positions. It can be accomplished by a driveable engagement claw provided on the fixed frame for selective engagement with an engagement groove provided on the printing drum supporting member. Alternatively, when the printing drum supporting member is adapted to rotate only in one direction, a ratchet mechanism may be used for the same purpose without requiring any power means.

If desired, the rotary actuator may also be provided on the fixed frame, instead of on the printing drum supporting member.

This assembly is particularly useful when included in a stencil printing device which may be equipped with the function of reading original images.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
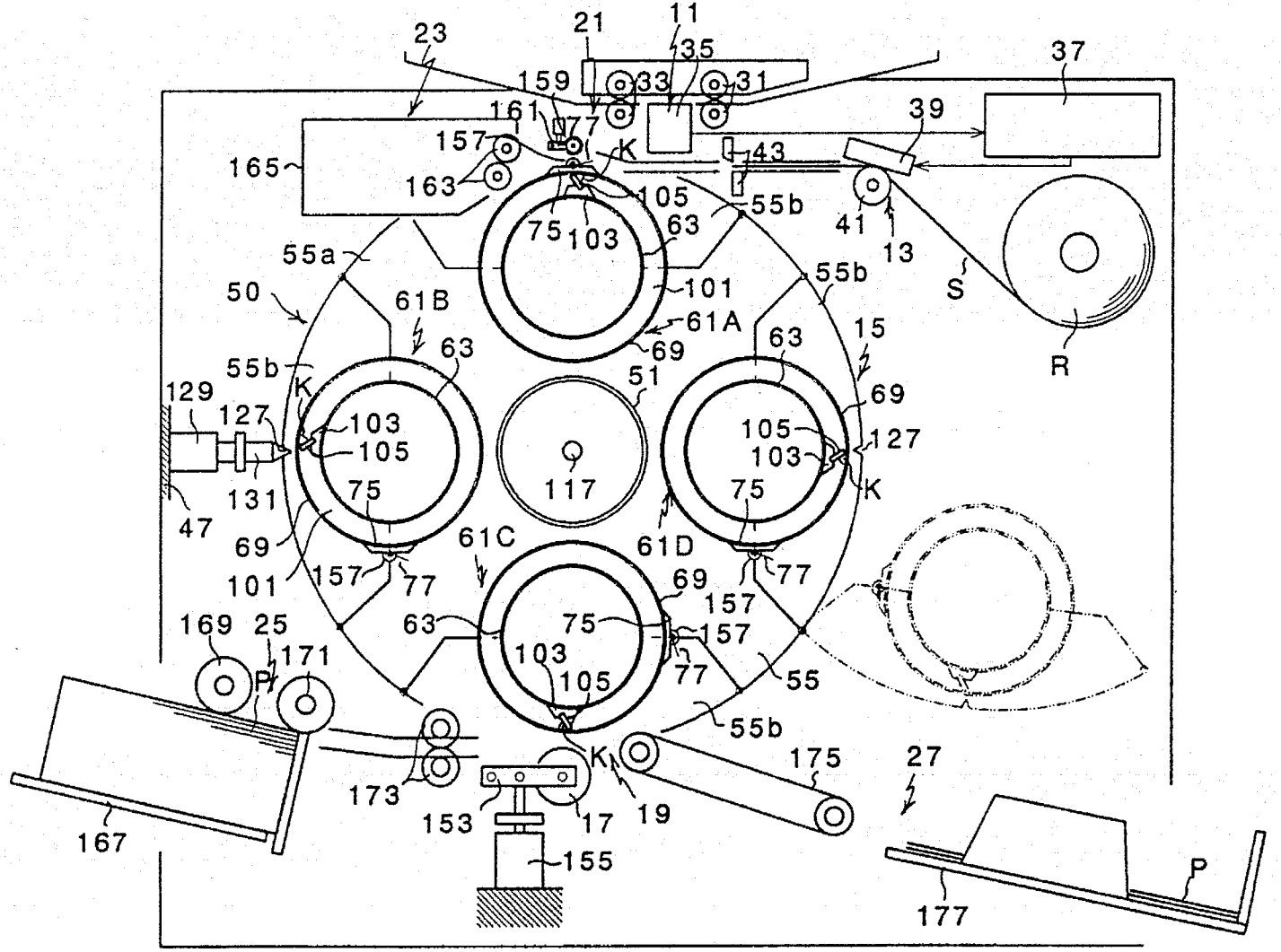
FIG. 1 is an overall structural view showing an embodiment of the multi printing drum stencil printing device according to the present invention.
Figure 2:
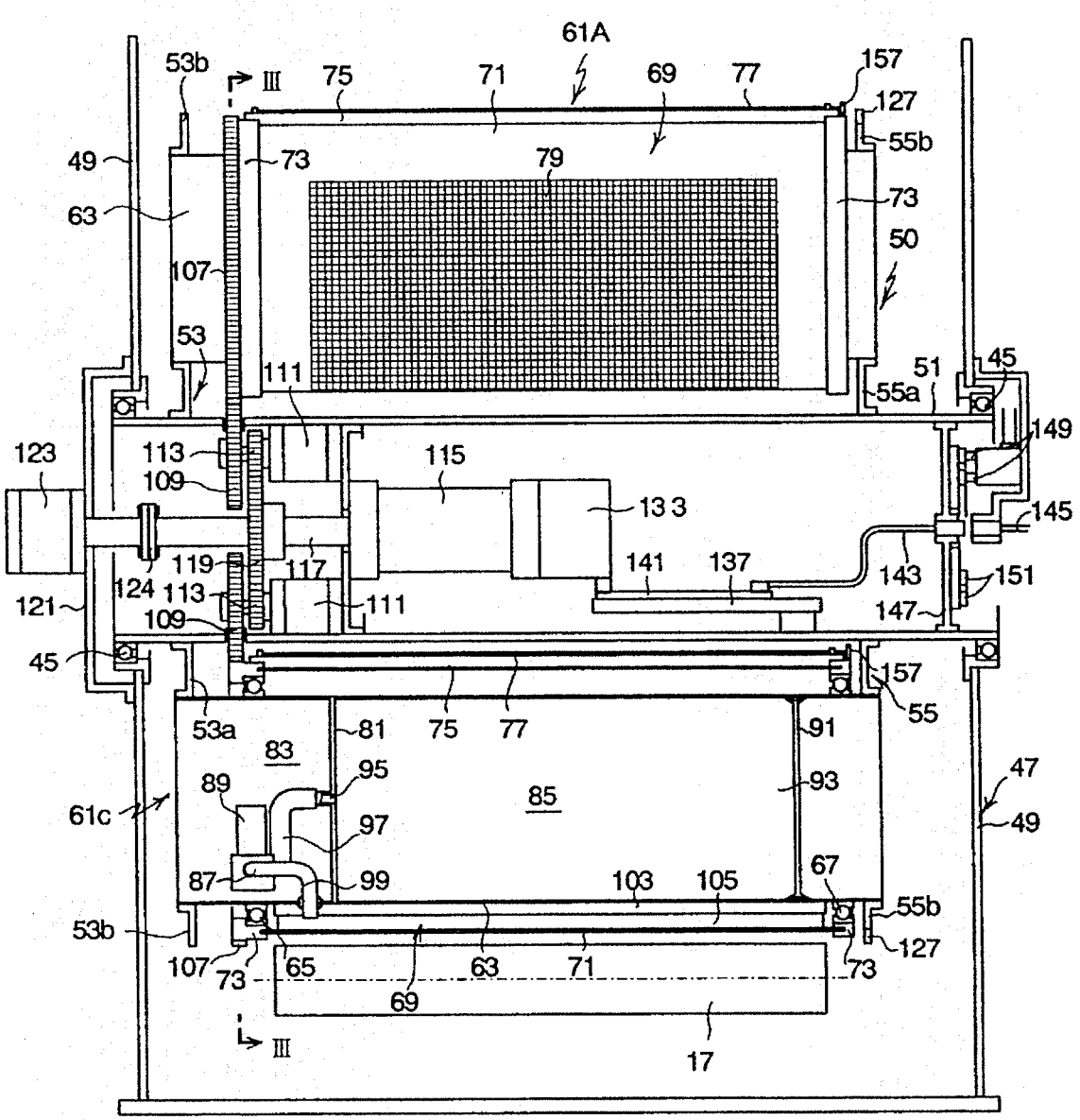
FIG. 2 is a longitudinal sectional view showing an embodiment of the device for supporting printing drums for rotative actuation thereof in a multi printing drum stencil printing device according to the present invention.
Figure 3:
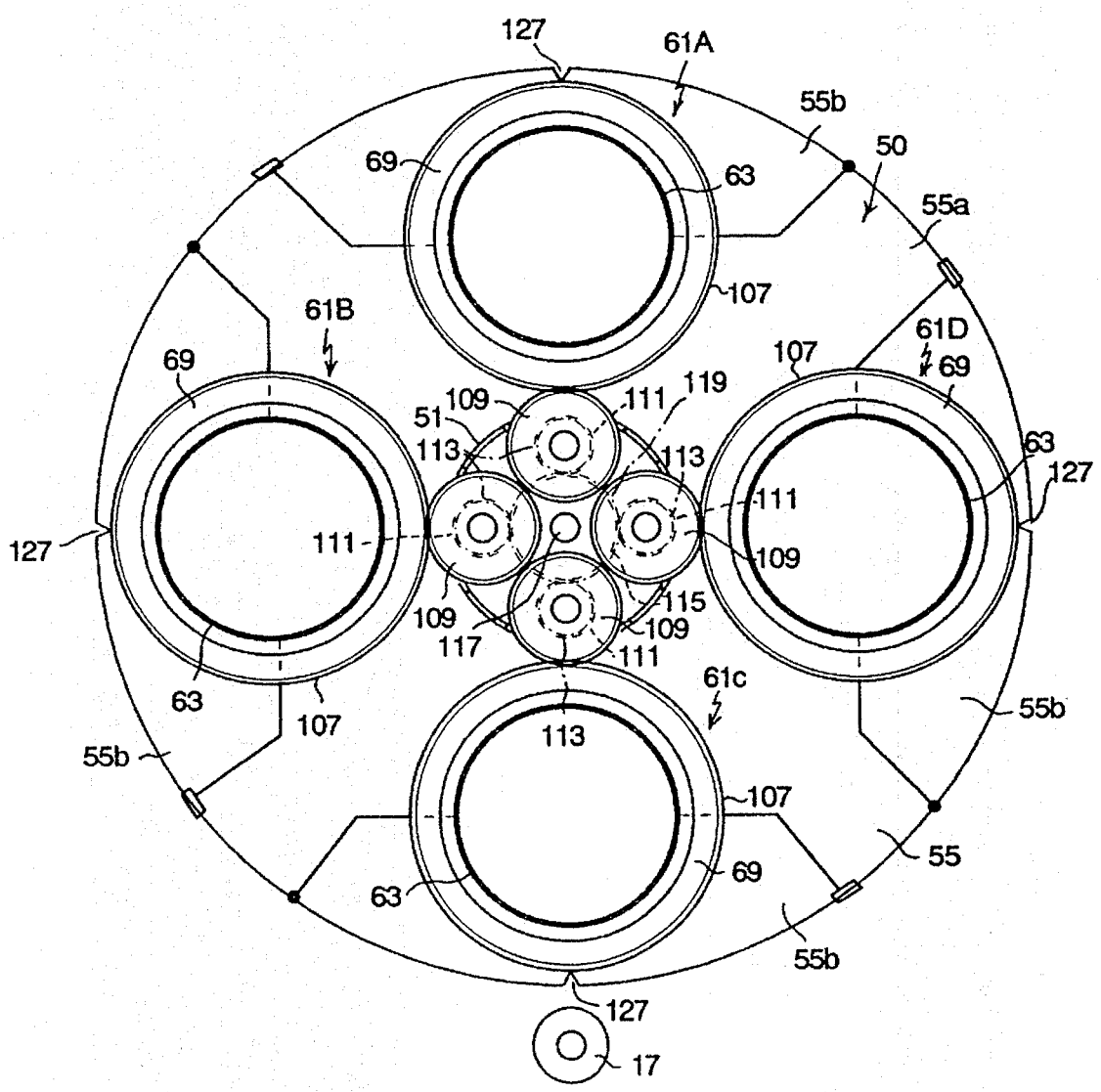
FIG. 3 is a sectional view taken along line III— III of FIG. 2.
Figure 4:
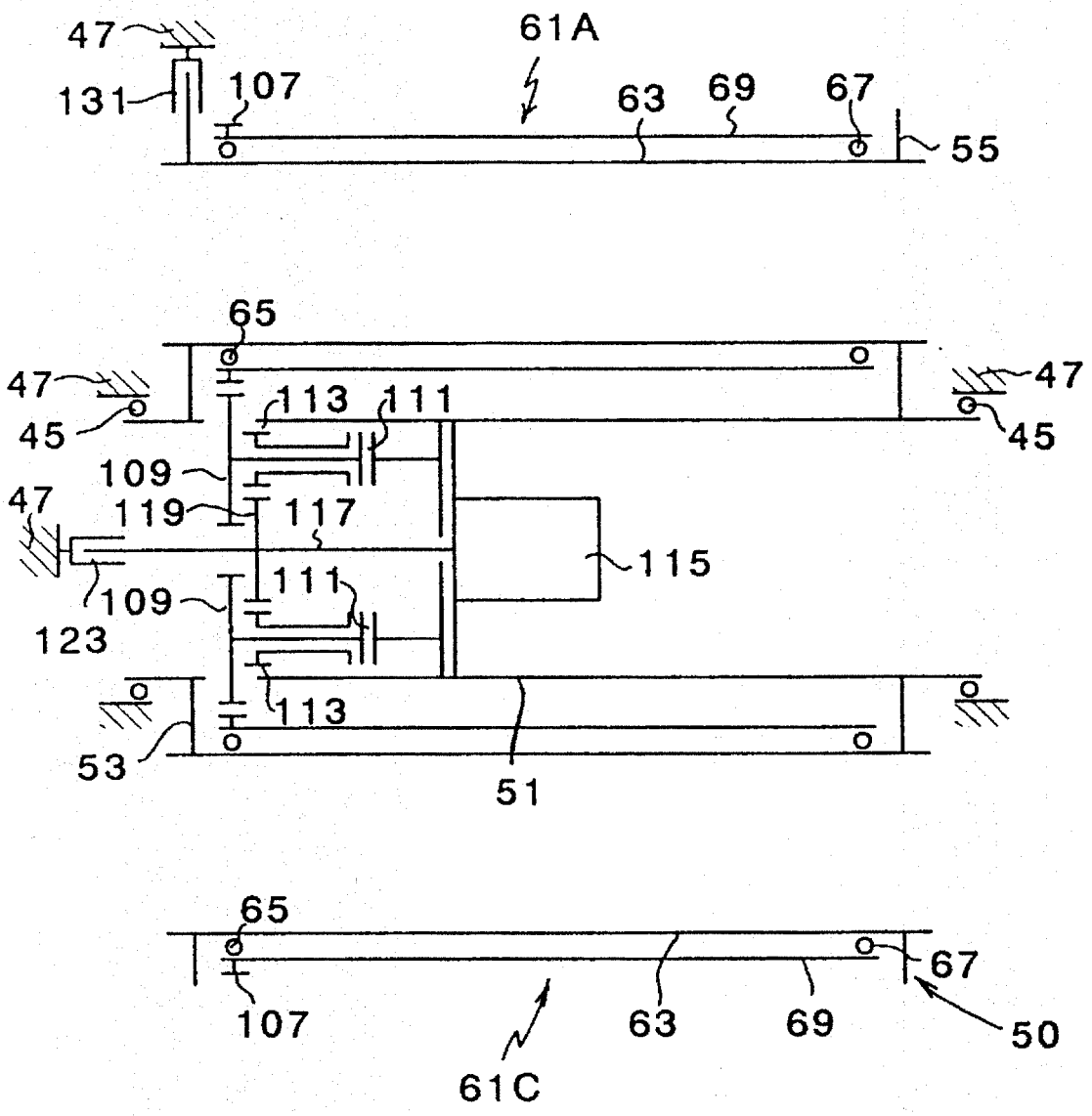
FIG. 4 is a skeleton diagram of the device for supporting printing drums for rotative actuation thereof shown in FIGS. 2 and 3.

FIGS. 1 through 4 show an embodiment of the multi printing drum stencil printing device including the device for supporting printing drums for rotative actuation thereof according to the present invention.

This multi printing drum stencil printing device comprises an original reading unit 11, a plate making unit 13, a printing drum supporting device 15 for rotative actuation of the printing drums, a printing unit 19 including a press roller 17, a plate mounting unit 21, a plate ejecting unit 23, a paper feeding unit 25, and a paper ejecting unit 27.

The original reading unit 11 consists of an image scanner, and comprises original feeding rollers 31 and 33 for feeding original sheets, and an image sensor 35 for reading the image on each of the original sheets, to supply an image signal obtained from the original sheet to an image processing unit 37.

The plate making unit 13 comprises a thermal head 39 consisting of an array of dot-like heat generating elements arranged in a single lateral row, a platen roller 41, and a master plate sheet cutter 43 so that a heat sensitive stencil master plate sheet S supplied from a roll unit R is thermally perforated into a stencil master plate in the manner of a dot matrix by the dot-like heat generating elements of the thermal head 39 which are individually and selectively heated according to a plate making image signal supplied from the image processing unit 37, and is cut into a prescribed size by the master plate sheet cutter 43.

The image processing unit 37 separates the original image read by the image sensor 35 into the colors of cyan, magenta, yellow and black, and produces a plate making image signal for each of the colors.

The printing drum supporting device 15 comprises a central cylinder 51 which is rotatably supported at its two axial ends by side plates 49 of a fixed frame 47 via rolling bearings 45. A pair of planetary side plates 53 and 55 are fixedly secured to the central cylinder 51 so as to generally form the printing drum supporting member 50.

The planetary side plates 53 and 55 are secured to the central cylinder 51 in a mutually axially spaced relationship, and carry a plurality, in this case four, of printing drum units 61A, 61B, 61C and 61D around the central axial line of the central cylinder 51, each supported at two axial ends thereof. In other words, the printing drum supporting member 50 supports the printing drum units 61A, 61B, 61C and 61D on a circle which is coaxial with the axial center line thereof.

The printing drum units 61A, 61B, 61C and 61D are arranged at the interval of a 90 degree indexing angle along the circumferential direction of the central cylinder 51, and are each provided with a cylindrical printing drum main body 69 which is coaxially arranged around a printing drum supporting cylinder 63, and is rotatably supported by the printing drum supporting cylinder 63 at two axial ends thereof via rolling bearings 65 and 67. The two ends of each printing drum supporting cylinder 63 are clamped between side plate main bodies 53*a* and 55*a* of the planetary side plates 53 and 55 and cap members 53*b* and 55*b* hinged to the associated side plate main bodies 53*a* and 55*a* so that the printing drum supporting cylinder 63 may be detachably mounted on the planetary side plates 53 and 55.

Each printing drum main body 69 consists of a cylinder shell 71, and a pair of terminal end supporting annular members 73 engaged to respective axial ends of the cylinder shell 71, and is rotatively supported by the printing drum supporting cylinder 63, so as to be rotatable around an axial line parallel to the central axial line of the central cylinder 51, at two axial ends thereof via rolling bearings 65 and 67 which are engaged by the respective terminal end supporting annular members 73.

Each printing drum main body 69 is provided with a platform member 75 fixedly secured to the outer circumferential surface thereof, and a master plate sheet clamping plate 77 associated with the platform member 75. A stencil master plate sheet S is clamped by the master plate sheet clamping plate 77 at its one end, and is mounted on the outer circumferential surface of the cylinder shell 71 which is formed as a porous ink permeable structure 79 by an electrocasting process or the like.

The interior of the printing drum main body 69 is separated by an internal partition wall 81 into a pump compartment 83 accommodating an ink supply pump 87 and a pump drive motor 89, and an ink bottle compartment 85.

A piston member 91 is axially slidably received in the ink bottle compartment 85, and an ink storage chamber 93 is defined between the piston member 91 and the internal partition wall 81. The internal partition wall 81 is provided with an ink outlet 95 for the ink storage chamber 93, and the ink outlet 95 is connected to the suction port of the ink supply pump 87 via an ink conduit 97.

The outlet port of the ink supply pump 87 is connected to an end of an ink supply conduit 99 which extends into an annular chamber defined between the printing drum supporting cylinder 63 and the printing drum main body 69 after passing through the printing drum supporting cylinder 63.

The outer circumferential surface of the printing drum supporting cylinder 63 is provided with a squeegee blade mounting unit 103 which in turn carries a squeegee blade 105 thereon. The squeegee blade 105 is made of rubber or rubber-like material, and engages the inner circumferential surface of the cylinder shell 71 of the printing drum main body 69 with prescribed squeegee angle and squeegee pressure.

The forward end of the ink supply conduit 99 is placed at a position slightly trailing the point of contact between the squeegee blade 105 and the cylinder shell 71 with regard to the direction of rotation of the printing drum main body 69. Thus, printing ink is supplied to a region slightly trailing the point of contact between the squeegee blade 105 and the cylinder shell 71 with regard to the direction of rotation of the printing drum main body 69 to form a small ink reservoir K (see FIG. 1) in this region.

The amount of printing ink in the ink reservoir K is detected by an ink amount sensor not shown in the drawings, and the actuation of the pump drive motor 89 is controlled according to the amount of printing ink detected by the ink amount sensor.

This ink amount sensor may be similar to the one disclosed in Japanese utility model publication for opposition purpose (kokoku) No. 03-28342, and associated electric circuits and the drive circuit for the pump drive motor 89 may be arranged in the pump compartment 83 so as not to be contaminated by the printing ink.

A ring gear 107 is coaxially arranged on the printing drum main body 69 of each of the printing drum units 61A, 61B, 61C and 61D, and the central cylinder 51 is provided with four gears 109 which individually mesh with the associated ring gears 107 of the printing drum units 61A, 61B, 61C and 61D.

Four electromagnetic clutch/brake units 111 are fixedly secured inside the central cylinder 51 so as to be individually associated with the gears 109, and each of the electromagnetic clutch/brake units 111 can be selectively switched over between a clutch engage condition in which the electromagnetic clutch/brake units 111 individually couple the gears 109 with the drive gears 113, and a brake engage condition in which each of the gears 109 is disengaged from the associated drive gear 113 and is fixedly engaged to the central cylinder 51. The clutch for each of the electromagnetic clutch/brake units 111 consists of a dog clutch which can engaged only at a certain phase relationship between its input and output ends while the brake for each of the electromagnetic clutch/brake units 111 consists of a friction brake which can be engaged at any phase relationship between its input and output ends.

An electric motor 115 is fixedly secured in a central part of the central cylinder 51. A central drive gear 119 is fixedly secured to an output shaft 117 of the motor 115 so as to mesh with all of the four drive gears 113 simultaneously. The output shaft 117 of the motor 115 is fixedly coupled, via a shaft coupling 124, with an electromagnetic brake 123 fixedly secured to the fixed frame 47 with a bracket 121. The electromagnetic brake 123 selectively secures the output shaft 117 as a braking action.

The outer periphery of the planetary side plate 55 is provided, for indexing purposes, with V-notches 127 at the interval of 90 degrees so as to correspond to the positions of the printing drum units 61A, 61B, 61C and 61D. The fixed frame 47 is provided with a locating pin 131 which can be actuated by a solenoid device 129 as illustrated in FIG. 1. When actuated by the solenoid device 129, the locating pin 131 selectively engages one of the four V-notches 127 to fixedly secure the printing drum supporting member 50 with respect to the fixed frame 47 at each of the indexing positions provided at the interval of 90 degrees.

The electric motor 115 is connected to a rotary encoder 133 for detecting the rotational angle of the output shaft of the motor 115, and the rotary encoder 133 can detect the rotational angle of the central cylinder 51 as well as those of the printing drum main bodies 69 of the printing drum units 61A, 61B, 61C and 61D.

A control circuit unit 141 is provided on a support plate 137 accommodated in the central cylinder 51 for the purpose of converting the output signal from the rotary encoder 133 to an optical signal. The optical signal produced from the control circuit unit 141 is transmitted in a contactless manner to an optical fiber 143 provided on the fixed frame 47 so as to oppose an optical fiber 145 disposed centrally in the central cylinder 51, and is supplied from a control device not shown in the drawing which, mounted on the main body frame 47, controls the overall action of the system. The control circuit unit 141 includes the control circuits for the motor 115, and the electromagnetic clutch/brake units 111, and receives command signals from the control device via the optical fibers 145 and 143.

In this case, the optical communication between the control device on the main body and the control circuit unit 141 is carried out both ways according to a prescribed communication protocol.

An end plate 147 fixedly secured to the central cylinder 51 is provided with an annular slip ring 151 which is engaged by power feeding brushes 149 provided on the fixed frame 47 so that electric power may be supplied to the electromagnetic clutch/brake units 111, the motor 115, the control circuit unit 141, and the pump drive motors 89 for the printing drum units 61A, 61B, 61C and 61D.

The circumferential position of the printing drum units 61A, 61B. 61C and 61D on each of the planetary side plates 53 and 55 are so determined that the squeegee blades 105 are placed at certain angular phase positions on the outer circumference of the planetary side plates 53 and 55, and the squeegee blade 105 for the lowermost printing drum unit (the printing drum unit 61C in FIG. 1), or the one in the printing position, opposes the press roller 17 by way of the cylinder shell 71 of the printing drum main body 69.

The press roller 17 is rotatably supported by levers 153, and can be reciprocated by a solenoid device 155 between a pressing position in which the press roller 17 is pushed against the outer circumferential surface of the printing drum main body 69, and a retracted position in which the press roller 17 is separated from the outer circumferential surface of the printing drum main body 69, in synchronism with the rotation of the printing drum main body 69.

A pivot shaft for the master plate sheet clamping plate 77 for each of the printing drum units 61A, 61B. 61C and 61D carries a small gear 157. The small gear 157 of the uppermost printing drum (the printing drum unit 61A in FIG. 1), or the one in the master plate mounting/ejecting position, selectively meshes with a drive gear 161 which is rotatively driven by a motor 159 of the plate mounting unit 21 so that the drive gear 161 may rotatively drive the master plate sheet clamping plate 77 between a clamping position and an unclamping position.

This clamping plate driving mechanism may be similar to the one disclosed in Japanese patent laid open publication (kokai) No. 59-96984 filed by the same applicant, and reference should be made to this patent document for more details.

This clamping plate driving mechanism may also be of the type in which the motor for actuating the clamping plate is provided in each of the printing drum units as disclosed in Japanese patent laid open publication (kokai) No. 05-116089 filed by the same applicant.

The plate ejecting unit 23 is provided with master plate sheet peeling rollers 163 for removing the stencil master plate sheet S mounted on the printing drum main body 69 of the printing drum unit located at the plate mounting/ejecting position as the printing drum main body 69 rotates, and forwarding the peeled stencil master plate sheet into an ejected plate box 165.

This plate ejecting mechanism may be similar to those disclosed in Japanese utility model laid open publication (kokai) No. 57-179972 and Japanese patent laid open publication (kokai) No. 60-71465, and for more details of the plate ejecting mechanism reference should be made to these patent documents.

The paper feeding unit 25 comprises a paper feeding table 167 for stacking printing paper P thereon, a paper feeding roller 169 and a paper separating roller 171 for taking out the printing paper P one sheet at a time, and timing rollers 173 for forwarding the printing paper P to the nip between the printing drum main body 69 and the press roller 17 in synchronism with the rotation of the printing drum main body 69.

The paper ejecting unit 27 comprises a belt conveying device 175 for conveying printed printing paper P, and a paper ejecting table 177 for stacking the printed printing paper P thereon.

Now the operation of the above described multi printing drum stencil printing device is described in the following.

In the condition illustrated in FIG. 1, the electromagnetic brake 123 is released, all of the electromagnetic clutch/brake units 111 are in the brake engage condition, the locating pin 131 is engaged with one of the V-notches 127 of the planetary side plates 55, and the printing drum supporting member 50 is fixedly secured to the fixed frame 47 at respective indexing positions. In the illustrated condition, the printing drum unit 61A is at the plate mounting/ejecting position.

When an original sheet to be printed is fed into the original reading unit 11 in this condition, the original sheet is scanned by the image sensor 35 while the original sheet is fed by the original feed rollers 31 and 33.

The image signal obtained from the original sheet by the image sensor 35 is supplied to the image processing unit 37 which separates the image signal into color separation signals for the four different colors of cyan, magenta, yellow and black, and produces image signals for making master plates for these different colors.

The image processing unit first of all supplies an image signal for a cyan master plate to the thermal head 39. Thus, a master plate for cyan color is formed on the stencil master plate sheet S, fed by the platen roller, by thermal perforation.

When a master plate is thus made, the stencil master plate sheet S is fed by the platen roller 41 to the printing drum unit 61A at its plate mounting/ejecting position. Once the leading edge of the stencil master plate sheet S reaches the platform member 75, the drive gear 161 meshes with the small gear 157, and the stencil master plate sheet S is clamped by the stencil master plate sheet clamping plate 77 moved by the motor 159 from the unclamping position to the clamping position. Upon completion of the clamping of the stencil master plate sheet S, the drive gear 161 is moved away from the small gear 157.

When the stencil master plate sheet S is fed to the printing drum unit 61A by the platen roller 41 while the master plate is being made on the stencil master plate sheet S, the electromagnetic clutch/brake unit 111 of the printing drum unit 61A is switched over from the brake engage position to the clutch engage position, and the motor 115 is rotatively actuated. The rotation of the motor 115 is transmitted to the ring gear 107 of the printing drum unit 61A via the output shaft 117, the central gear 119, and the gears 113 and 109, and the printing drum main body 69 of the printing drum unit 61A is rotated in counter clockwise direction as seen in FIG. 1 around the central axial line of the printing drum supporting cylinder 63. This rotation of the printing drum main body 69 causes the stencil master plate sheet S to be mounted on the outer circumferential surface of the printing drum main body 69.

Upon completion of the process of making a master plate, the stencil master plate sheet S is cut by the master plate sheet cutter 43 into a prescribed size. When the thus processed stencil master plate is mounted on the outer circumferential surface of the printing drum main body 69, the rotation of the motor 115 is stopped, and the rotation of the printing drum main body 69 is stopped.

When a used stencil master plate is mounted on the outer circumferential surface of the printing drum main body 69 when the new stencil master plate is to be mounted thereon, the used master plate is removed from the printing drum main body 69 by the plate ejecting unit 23 prior to the mounting of the new stencil master plate.

First of all, the electromagnetic clutch/brake unit 111 of the printing drum unit 61A is switched over from the clutch engage position to the brake engage position, and the output shaft 117 is fixedly secured to the fixed frame 47 by the electromagnetic brake 123 providing the necessary braking action. The locating pin 131 is disengaged from the V-notch 127 by the action of the solenoid device 129.

When the motor 115 is rotatively actuated in this condition, the printing drum supporting member 50 is rotated around the output shaft 117 in clockwise direction as seen in FIG. 1. When the printing drum supporting member 50 has rotated 180 degrees from its initial position, the solenoid device 155 actuates the locating pin 131 into engagement with the next V-notch 127 provided in the planetary side plate 55, and the printing drum supporting member 50 is again secured at one of its indexing positions.

Thus, the printing drum unit 61A is now located at the printing position while the printing drum unit 61C is located at the plate mounting/ejecting position.

Upon mounting a stencil master plate, the electromagnetic brake 123 is released, the electromagnetic clutch/brake unit 111 is switched over from the brake engage condition to the clutch engage condition, and the motor 115 is activated. As a result, the printing drum main body 69 of the printing drum unit 61A is rotated in counter clockwise direction as seen in FIG. 1.

At this time, printing paper P is supplied from the paper feeding unit 25 to the nip between the printing drum main body 69 and the press roller 17, and the printing paper P is pressed onto the stencil master plate sheet S mounted on the outer circumferential surface of the printing drum main body 69 by the press roller 17 moved into its pressing position by the solenoid device 155 in synchronism with the rotation of the printing drum main body 69 so as to carry out a stencil printing of cyan color on the printing paper P as a first printing step. The printed printing paper P is ejected onto the paper ejecting table 177 by the conveying device 175.

While this step of carrying out a stencil printing of cyan color is being executed, a stencil master plate for magenta color is formed on the stencil master plate sheet S by the plate making unit 13, and the prepared stencil master plate is mounted on the outer circumferential surface of the printing drum main body 69 of the printing drum unit 61C located at the plate mounting/ejecting position in the same way as the mounting of the cyan stencil master plate.

Before this step of mounting a master plate is executed, the electromagnetic clutch/brake unit 111 of the printing drum unit 61C is switched over from the brake engage position to the clutch engage position, and the motor rotatively actuates not only the printing drum main body 69 of the printing drum unit 61A but also the printing drum main body 69 of the printing drum unit 61C in counter clockwise direction as seen in FIG. 1 for mounting the stencil master plate thereon.

Upon completion of the step of stencil printing of cyan color, the rotation of the printing drum main body 69 of the printing drum unit 61A by the motor 115 is stopped, and all of the electromagnetic clutch/brake units 111 are brought into the brake engage position while the locating pin 131 is disengaged from the V-notch 127 by the solenoid device 129 so as to cause the electromagnetic brake 123 to secure the output shaft 117 to the fixed frame 47 by its braking action.

With the electric motor 115 rotatively actuated in this condition, the printing drum supporting member 50 is rotated in clockwise direction as seen in FIG. 1 around the output shaft. When the printing drum supporting member 50 has rotated 180 degrees from its initial position, the motor 115 is stopped from rotating, and the locating pin 131 is made to engage the next V-notch 127 of the planetary side plate 55 by the solenoid device 129 so as to again fixedly secure the printing drum supporting member 50 at one of its indexing positions.

In this condition, the printing drum unit 61A is at the printing position, and the printing drum unit 61A is at the plate mounting/ejecting position.

Then, the electromagnetic brake is released, the electromagnetic clutch/brake unit 111 of the printing drum unit 61A is switched over from the brake active condition to the clutch engage condition, the motor 115 is activated, and a stencil printing of magenta color is carried out in the same way as the stencil printing of cyan color by rotatively actuating the printing drum main body 69 of the printing drum unit 61C in counter clockwise direction as seen in FIG. 1.

Upon completion of the magenta stencil printing, the rotary actuation of the printing drum main body 69 of the printing drum unit 61C by the motor 115 is stopped, the electromagnetic clutch/brake unit 111 is switched over to the brake active condition, the locating pin 131 is disengaged by the solenoid device 129 from the V-notch 127, and the output shaft 117 is fixedly secured to the fixed frame 47 by the braking action effected by the electromagnetic brake 123.

With the motor 115 rotatively actuated in this condition, the printing drum supporting member 50 is rotated around the output shaft 117 in clockwise direction as seen in FIG. 1. When the printing drum supporting member 50 has rotated 90 degrees from its initial position, the motor 115 is stopped from rotating, and the locating pin 131 is engaged by the solenoid device 129 with the next V-notch 127 of the planetary side plate 55 to secure the printing drum supporting member 50 at this indexing position.

In this condition, the printing drum unit 61B is located at the plate mounting/ejecting position, a stencil master plate for yellow color is formed on the stencil master plate sheet S by the plate making unit 13 in the same way as the stencil master plate for cyan color, and the prepared stencil master plate is mounted on the outer circumferential surface of the printing drum main body 69 of the printing drum unit 61B located at the plate mounting/ejecting position in the same way as the mounting of the cyan stencil master plate.

Upon completion of this step of mounting a stencil master plate with respect to the printing drum unit 61B, the electromagnetic clutch/brake unit 111 thereof is switched over to the brake engage position, the locating pin 131 is disengaged from the V-notch 127 by the solenoid device 129 and the output shaft 117 is fixedly secured to the fixed frame 47 by the braking action of the electromagnetic brake 123.

With the electric motor 115 rotatively actuated in this condition, the printing drum supporting member 50 is rotated in clockwise direction as seen in FIG. 1 around the output shaft 117. When the printing drum supporting member 50 has rotated 180 degrees from its initial position, the motor 115 is stopped from rotating, and the locating pin 131 is made to engage the next V-notch 127 of the planetary side plate 55 by the solenoid device 129 so as to again fixedly secure the printing drum supporting member 50 at one of its indexing positions.

In this condition, the printing drum unit 61B is at the printing position, and the printing drum unit 61D is at the plate mounting/ejecting position.

Then, the electromagnetic brake 123 is released, the electromagnetic clutch/brake unit 111 of the printing drum unit 61B is switched over from the brake active condition to the clutch engage condition, the motor 115 is activated, and a stencil printing of yellow color is carried out in the same way as the stencil printing of magenta color by rotatively actuating the printing drum main body 69 of the printing drum unit 61B in counter clockwise direction as seen in FIG. 1.

While this step of carrying out a stencil printing of yellow color is being executed, a stencil master plate for black color is formed on the stencil master plate sheet S by the plate making unit 13 in the same way as the stencil master plate for cyan color, and the prepared stencil master plate is mounted on the outer circumferential surface of the printing drum main body 69 of the printing drum unit 61D located at the plate mounting/ejecting position in the same way as the mounting of the cyan stencil master plate.

Upon completion of the yellow stencil printing, the rotary actuation of the printing drum main body 69 of the printing drum unit 61B by the motor 115 is stopped, the electromagnetic clutch/brake unit 111 is switched over to the brake active condition, the locating pin 131 is disengaged by the solenoid device 129 from the V-notch 127, and the output shaft 117 is fixedly secured to the fixed frame 47 by the braking action effected by the electromagnetic brake 123.

With the motor 115 rotatively actuated in this condition, the printing drum supporting member 50 is rotated around the output shaft 117 in clockwise direction as seen in FIG. 1. When the printing drum supporting member 50 has rotated 180 degrees from its initial position, the motor 115 is stopped from rotating, and the locating pin 131 is engaged by the solenoid device 129 with the next V-notch 127 of the planetary side plate 55 to secure the printing drum supporting member 50 at this indexing position.

In this condition, the printing drum unit 61D is at the printing position.

Then, the electromagnetic brake 123 is released, the electromagnetic clutch/brake unit 111 is switched over from the brake engage condition to the clutch engage condition with the motor 115 activated, and the motor 115 is rotatively actuated so that the printing drum main body 69 of the printing drum unit 61D is rotated in counter clockwise direction as seen in FIG. 1 to carry out a black stencil printing in the same manner as the cyan stencil printing.

In this way, a full color printing can be carried out without requiring any manual work for replacing the printing drums.

Figure 5:
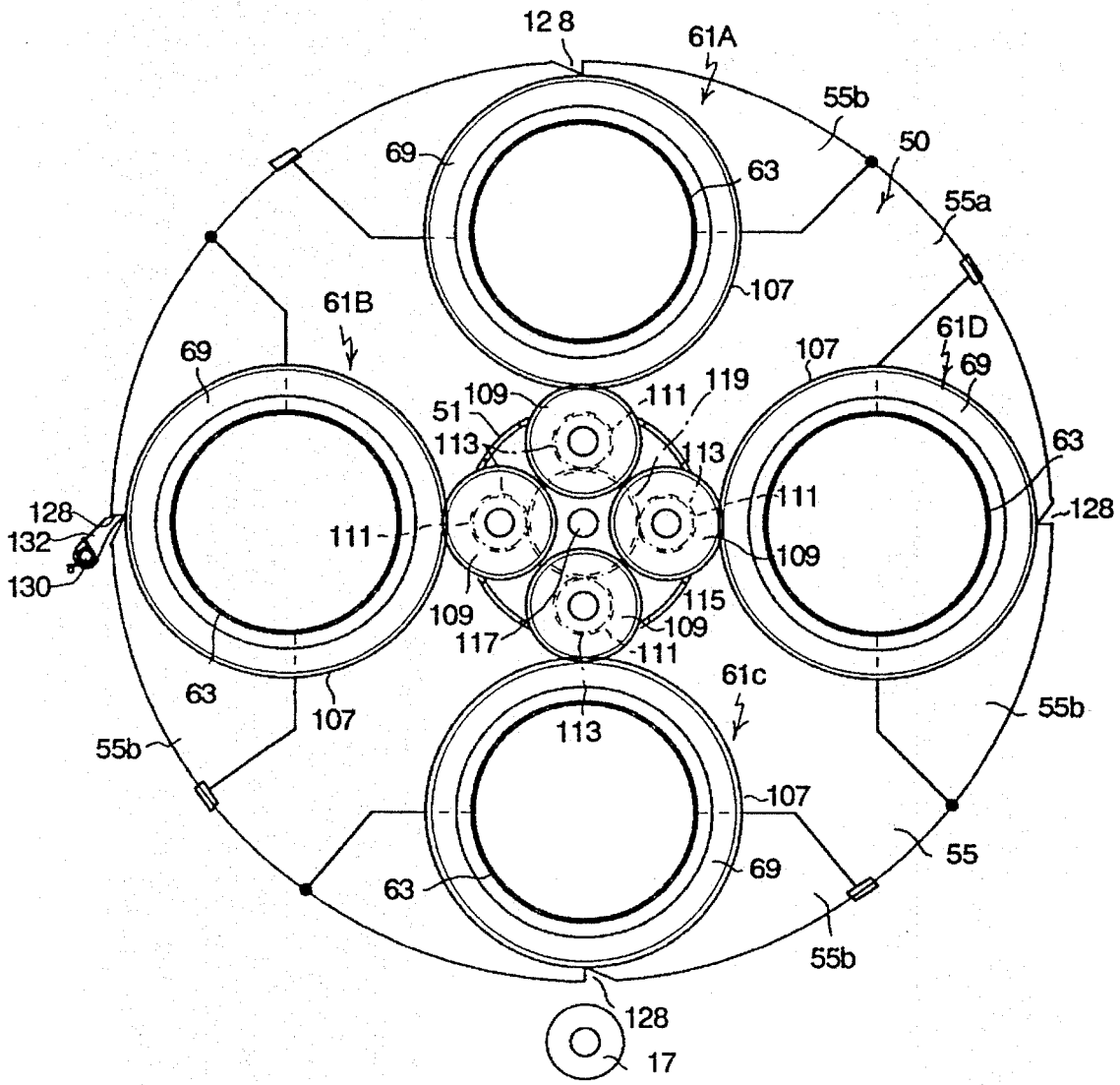
FIG. 5 is a longitudinal sectional view showing another embodiment of the device for supporting printing drums for rotative actuation thereof in a multi printing drum stencil printing device according to the present invention.

In the above described embodiment, each of the printing drum supporting members are secured while the associated printing drum is rotating by engaging the locating pin 131 with the associated V-notch 127. However, it is also possible to use a belt brake to achieve a same goal. Because the rotation of the printing drum main body 69 is uni-directional, the printing drum supporting member 50 may be capable of supporting only the reaction of the printing drum main body 69 with respect to the rotation thereon only in one direction. Therefore, the securing of the printing drum supporting member 50 may be effected by a ratchet mechanism consisting of an engagement groove 128 provided on the outer circumferential surface of the planetary side plate 55, and a ratchet pawl 132 urged by a spring 130 into the engagement groove 128 as shown in FIG. 5. In this case, the rotational direction of the printing drum main body 50 would be in the direction to release the ratchet mechanism.

Figure 6:
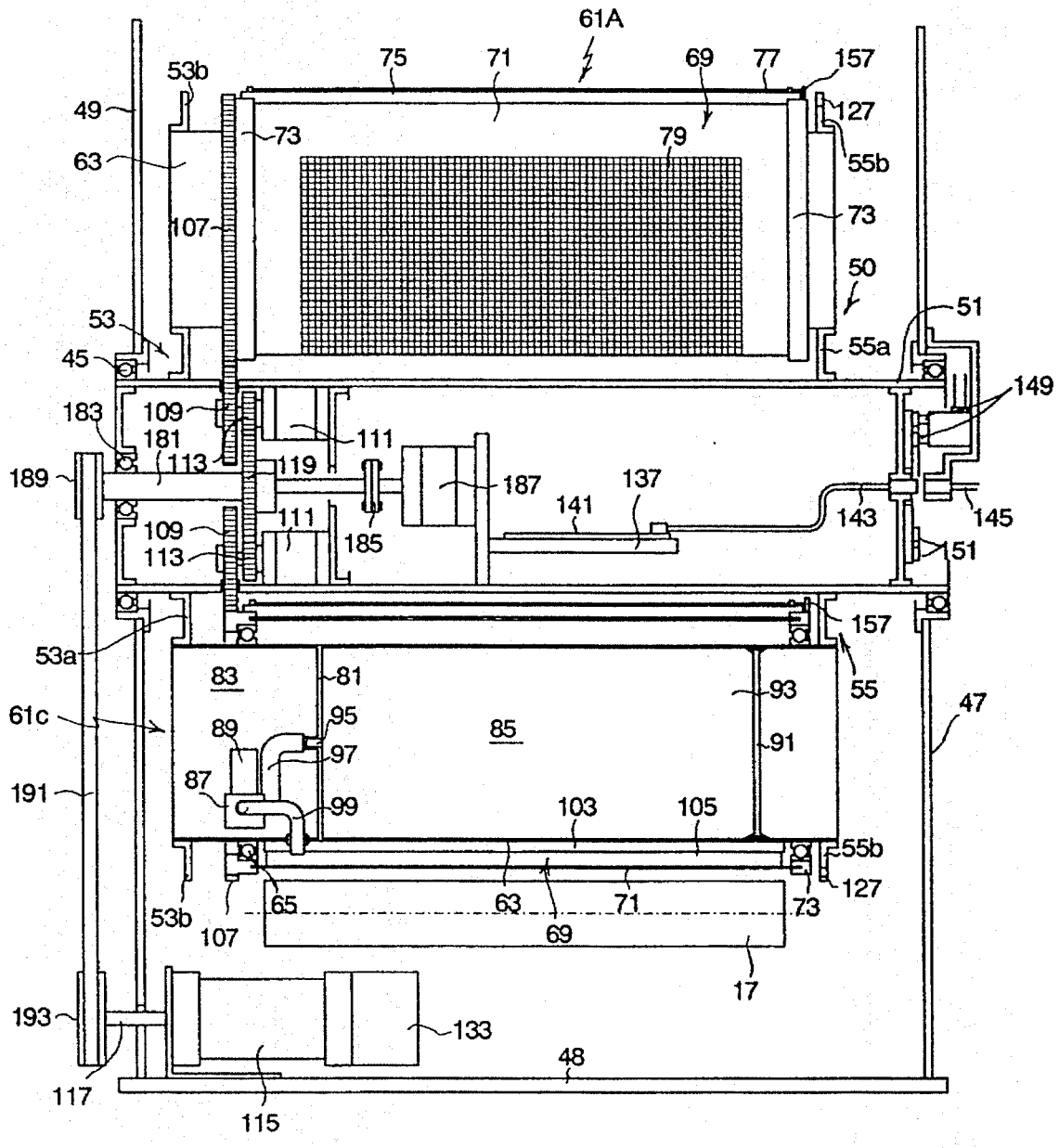
FIG. 6 is a longitudinal sectional view showing yet another embodiment of the device for supporting printing drums for rotative actuation thereof in a multi printing drum stencil printing device according to the present invention.
Figure 7:
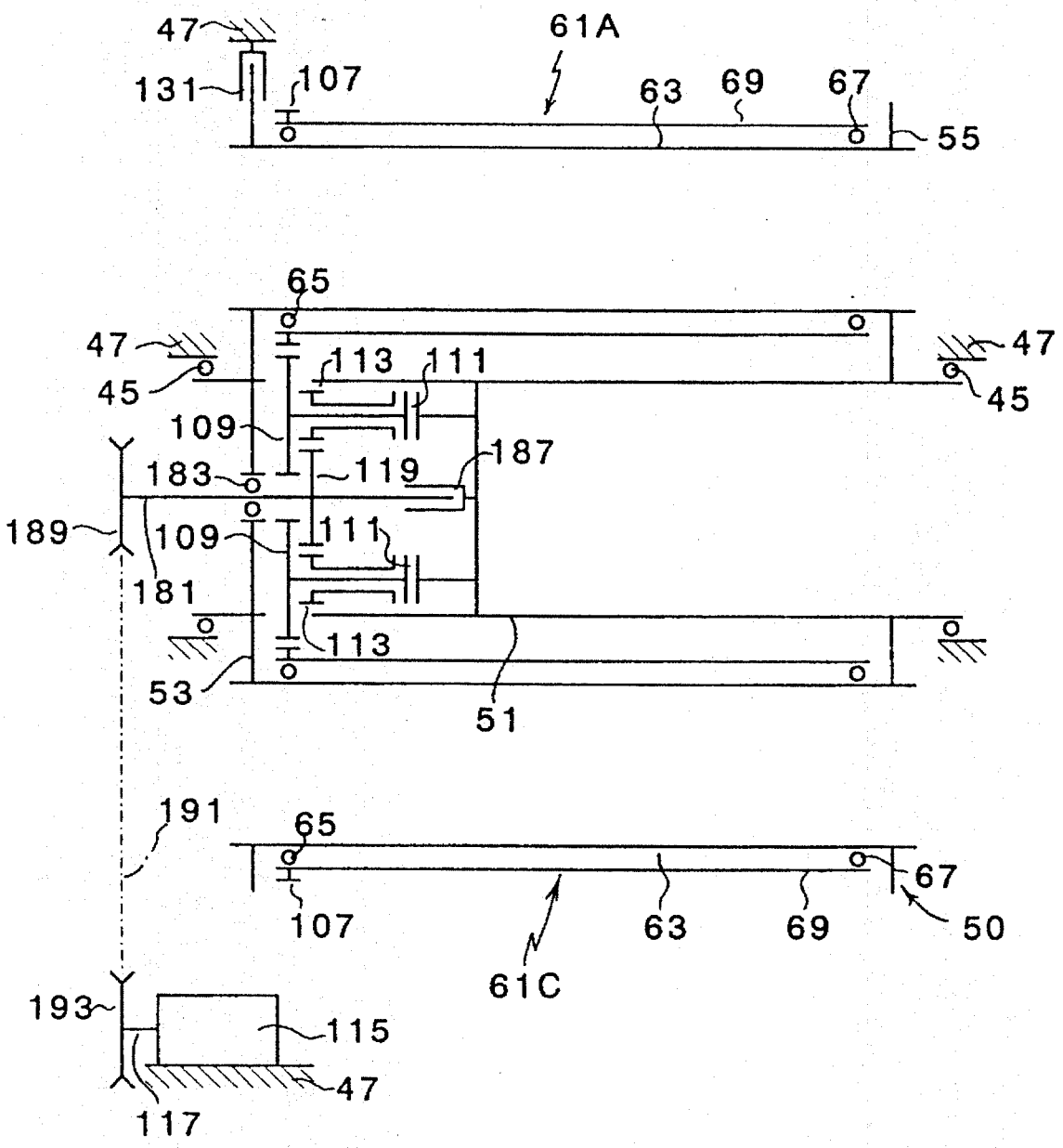
FIG. 7 is a skeleton diagram of the device for supporting printing drums for rotative actuation thereof shown in FIG. 6.

FIGS. 6 and 7 show another embodiment of the device for supporting printing drums for rotative actuation thereof in a multi printing drum stencil printing device according to the present invention. In FIGS. 6 and 7, the parts corresponding to those of FIGS. 1 through 4 are denoted with like numerals.

In this embodiment, a central shaft 181 equipped with a central drive gear 119, instead of the output shaft 117 of the motor 115, is rotatively supported by a rolling bearing 183 in a central part of the central cylinder 51. The rolling bearing 183 is connected to an electromagnetic clutch 187 via a shaft coupling 185, and the electromagnetic clutch 187 selectively couples the central shaft 181 with the central cylinder 51.

One end of the central shaft 181 projects out of the central cylinder 51, and this projecting end is drivingly connected, via a pulley 189, a timing belt 191, and a pulley 193, to an output shaft 117 of a motor 115 securely mounted on a bottom plate 48 of the fixed frame 47.

In this embodiment, when the locating pin 131 is disengaged from the V-groove 127 of the planetary side plate 55, all of the electromagnetic clutch/brake units 111 are brought into the brake engage condition, and the electromagnetic clutch 187 is in the clutch engage condition, the motor 115 is rotatively actuated with the result that the printing drum supporting member 50 rotates around itself, and the positions of the printing drum units 61A, 61*b*, 61C and 61D are changed.

Meanwhile the locating pin 131 engages with the V-groove 127 of the planetary side plate 55, the electromagnetic clutch/brake units 111 are brought into the clutch engage condition, and the electromagnetic clutch 187 is disengaged. As the motor 115 is rotatively actuated in this condition, the printing drum main body 69 of a selected one of the printing drum units 61A, 61*b*, 61C and 61D is rotated, and the steps of printing, ejecting a used plate, and mounting a new plate.

Figure 8:
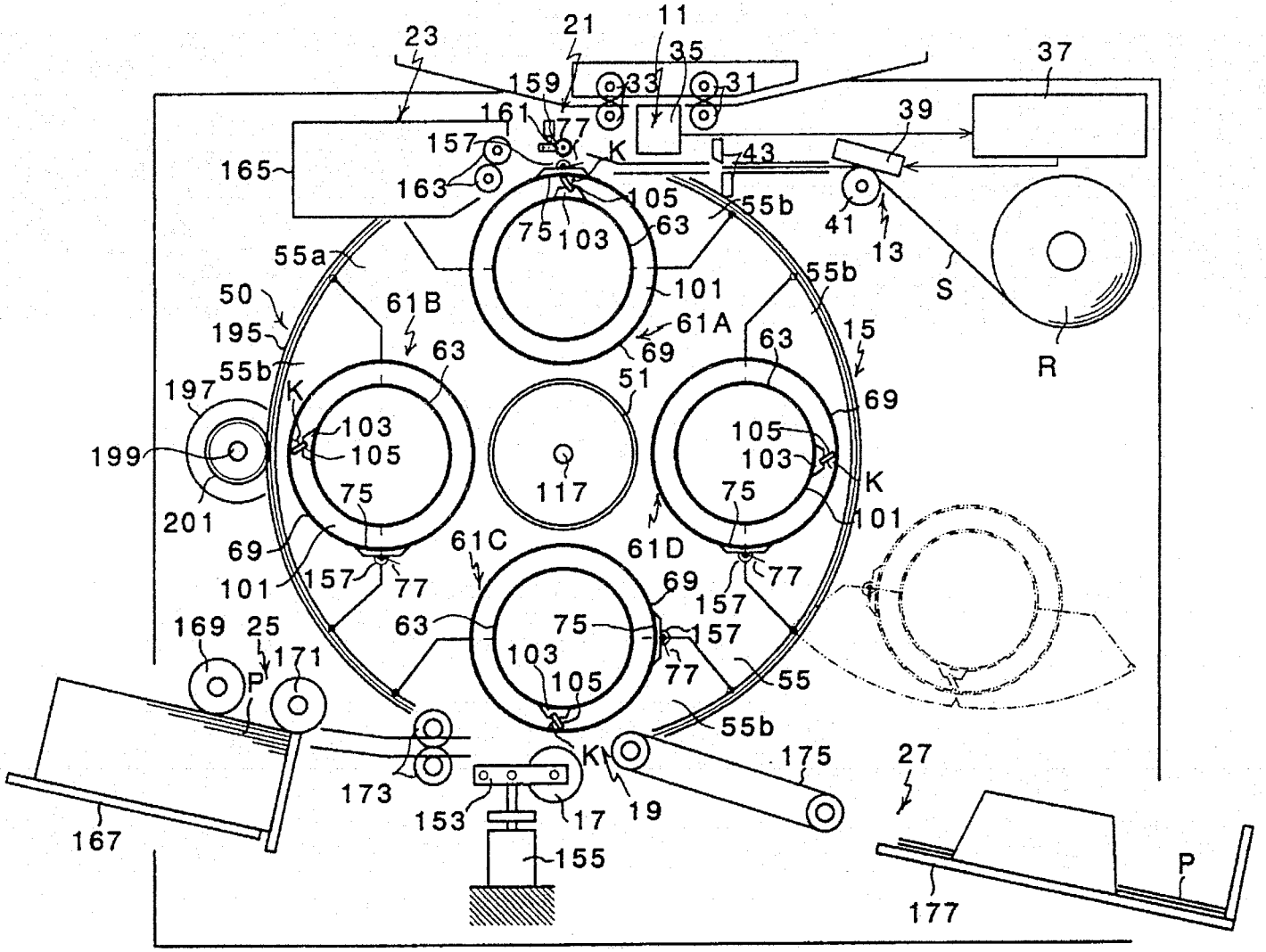
FIG. 8 is an overall structural view showing yet another embodiment of the multi printing drum stencil printing device including the device for supporting printing drums for rotative actuation thereof according to the present invention.
Figure 9:
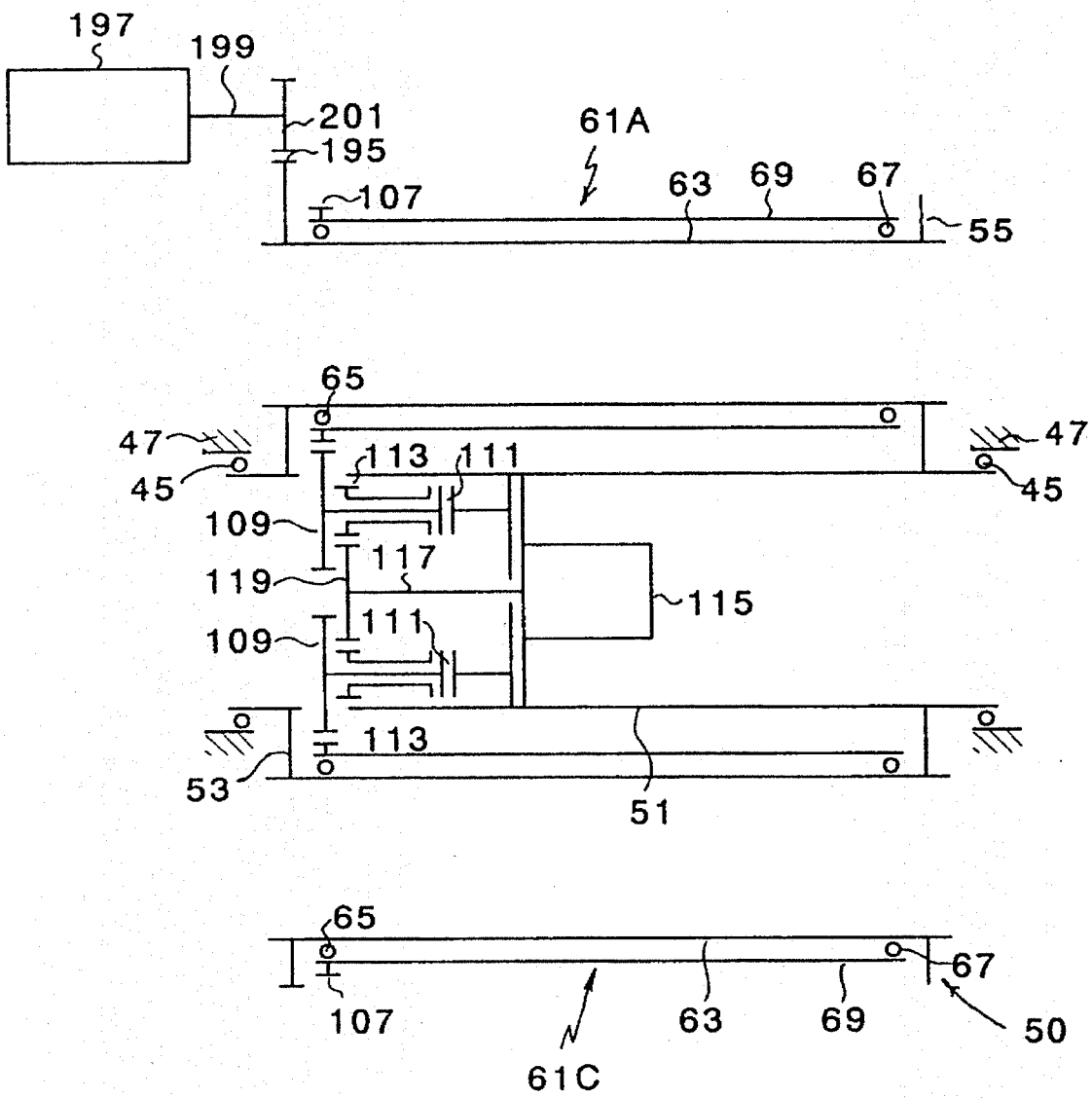
FIG. 9 is a skeleton diagram of the device for supporting printing drums for rotative actuation thereof shown in FIG. 8.

FIGS. 8 and 9 show another embodiment of the multi printing drum stencil printing device according to the present invention. In FIGS. 8 and 9, the parts corresponding to those of FIGS. 1 through 4 are denoted with like numerals.

In this embodiment, an outer gear 195 is formed around the planetary side plate 55 which meshes with a drive gear 201 fitted on an output shaft 199 of a drive motor 197 for planetary motion.

In this embodiment, the motor 115 is used only for the rotary actuation of the printing drum main bodies 69 of the printing drum units 61A, 61*b*, 61C and 61D, and the indexing rotary movement of the printing drum supporting member 50 is effected by a separate drive motor 197 for planetary motion. In this case, securing of the printing drum main body 69 during the rotative actuation of the printing drum main body 69 by the motor 115 may be effected by the electromagnetic braking action of the drive motor 197 for planetary motion or by an electromagnetic brake attached to the drive motor 197 for planetary motion. The locating pin 131 may be omitted. The electromagnetic brake 123 may also be omitted.

Figure 10:
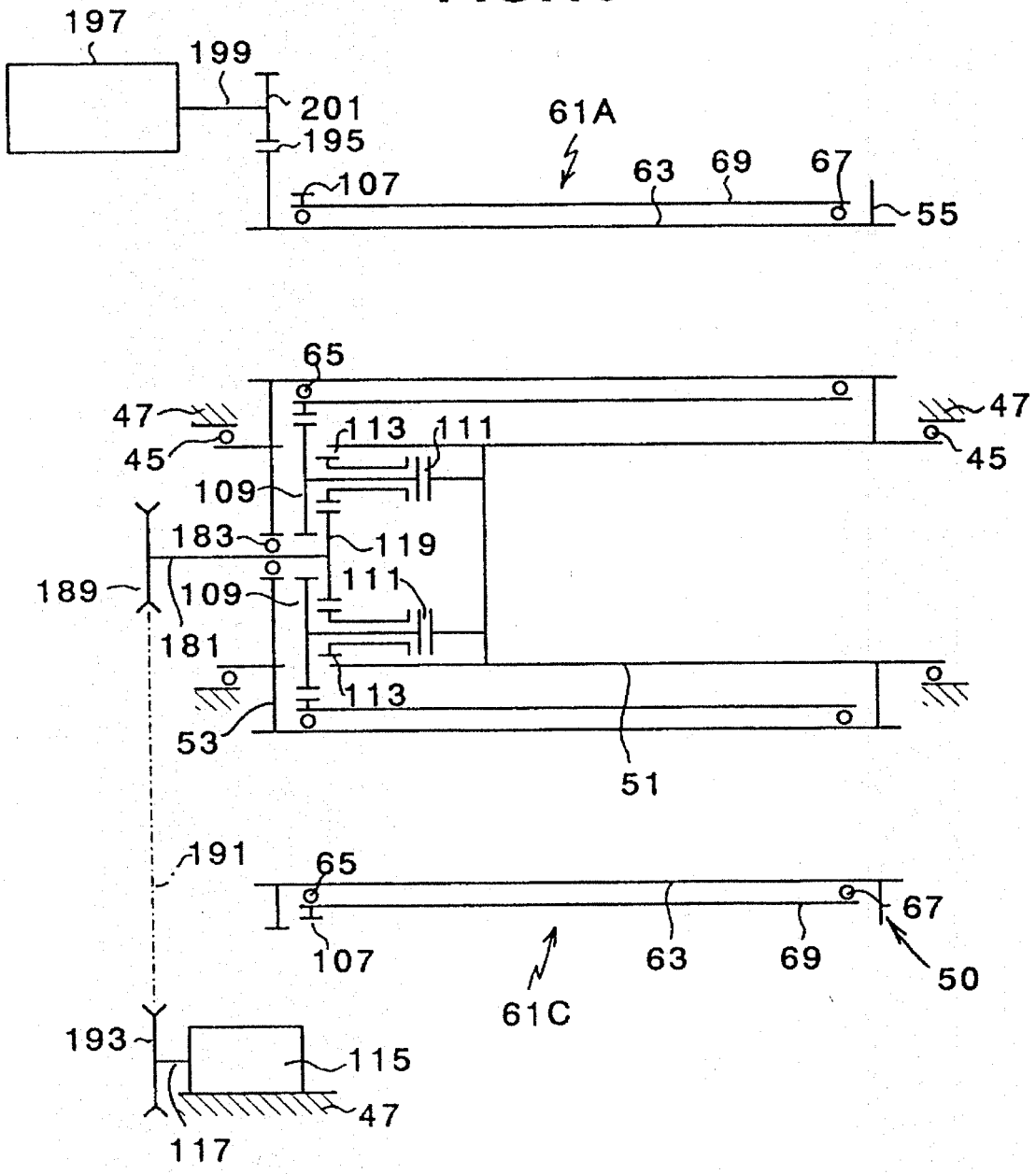
FIG. 10 is a skeleton diagram of yet another embodiment of the device for supporting printing drums for rotative actuation thereof according to the present invention.

FIG. 10 shows yet another embodiment of the multi printing drum stencil printing device according to the present invention. In FIG. 10, the parts corresponding to those of FIGS. 7 and 9 are denoted with like numerals.

In this embodiment also, an outer gear 195 is formed around the outer circumferential surface of the planetary side plate 55 which meshes with a drive gear 201 fitted on an output shaft 199 of a drive motor 197 for planetary motion.

In this embodiment, an external motor 115 is used only for the rotary actuation of the printing drum main bodies 69 of the printing drum units 61A, 61*b*, 61C and 61D, and the indexing rotary movement of the printing drum supporting member 50 is effected by the separate drive motor 197 for planetary motion. In this case also, securing of the printing drum main body 69 during the rotative actuation of the printing drum main body 69 by the motor 115 may be effected by the electromagnetic braking action of the drive motor 197 for planetary motion or by an electromagnetic brake attached to the drive motor 197 for planetary motion. The locating pin 131 may be omitted. The electromagnetic brake 123 may also be omitted.

In any one of these embodiments, the braking action of the electromagnetic clutch/brake units 111 is not essential to the present invention, and they may be replaced by electromagnetic clutches.

As can be understood from the above description, according to the device for supporting printing drums for rotative actuation thereof in a multi printing drum stencil printing device of the present invention, a plurality of printing drums provided on the printing drum supporting member are individually and selectively actuated by a common rotary actuator (motor) according to the engagement conditions of power transmitting means equipped with clutches. Therefore, each of the printing drums is not required to be equipped with an individual motor, and the number of necessary motors can be reduced without regard to the number of the printing drums.

When the rotary actuator is activated with the printing drum supporting member securing means releasing the printing drum supporting member, and the brake means or the clutch means being engaged, the printing drum supporting member rotates around itself along with the printing drums. When the rotary actuator is activated with the printing drum supporting member securing means securing the printing drum supporting member, and the brake means or the clutch means being disengaged, the printing drums are individually and selectively actuated depending on the engagement conditions of the power transmitting means equipped with clutches. Thus, the indexing rotary movement of the planetary side plate and the rotary actuation of each of the printing drums can be effected with a common motor without regard to the number of printing drums.

Because the indexing rotary movement of the planetary side plate and the rotary actuation of each of the printing drums are effected by a common motor, the detection of the angular position of this motor allows the indexing rotary angle of the planetary side plate and the rotational angle of each of the printing drums in a comprehensive manner, and the control of the indexing rotary movement of the planetary side plate and the rotary actuation of each of the printing drums can be accomplished in a centralized manner. This allows the number of necessary motors to be reduced, more compact and light weight design of the multi printing drum stencil printing device to be achieved, and the effort required for maintenance work to be reduced.

When a plurality of printing drums are arranged around a central axial line of the printing drum supporting member in concentric arrangement, a relatively large dead space is created in the middle part of the printing drum supporting member. However, by placing the motor in this space, the dead space is effectively utilized, and the size of the multi printing drum stencil printing device can be reduced.

According to the multi printing drum stencil printing device equipped with a device for supporting printing drums for rotative actuation thereof as taught by the present application, a full color printing can be accomplished in a simple manner by appropriately changing the printing drums without requiring any manual work.

According to the multi printing drum stencil printing device equipped with a device for supporting printing drums for rotative actuation thereof as taught by the present application, by providing image reading means for reading an original image, image processing means for color separating the original image read by the image reading means, and generating an image signal for making a master plate for each color, and plate making means for making a master plate on a stencil master plate sheet according to the signal for plate making obtained from the image processing means, plate making for full color printing and printing can be automatically accomplished according to a sequence control.

Although the present invention has been described in terms of a specific embodiment thereof, it is possible to modify and alter details thereof without departing from the spirit of the present invention.

What we claim is:

1. An assembly for supporting a plurality of printing drums for rotative actuation thereof in a multi printing drum stencil printing device, comprising:

a fixed frame;

a printing drum supporting member rotatably supported by said fixed frame around a central axial line of said printing drum supporting member;

a plurality of cylindrical printing drums each adapted to have a stencil master plate sheet mounted around an outer circumferential surface thereof and mounted on said printing drum supporting member so as to be rotatable around an axial line parallel to said central axial line of said printing drum supporting member;

a rotary actuator mounted on said printing drum supporting member, said rotary actuator having an output shaft;

power transmitting means adapted to selectively and individually engage each of said printing drums with said output shaft of said rotary actuator; and printing drum supporting member driving means for effecting an indexing rotary motion of said printing drum supporting member.

2. An assembly according to claim 1, wherein said printing drum supporting member driving means comprises output shaft securing means for selectively securing said output shaft of said rotary actuator so as to effect said indexing rotary motion of said printing drum supporting member with a reaction force produced by said rotary actuator when said output shaft thereof is secured by said output shaft securing means.

3. An assembly according to claim 1, wherein said power transmitting means comprises clutches for selectively transmitting an output torque of said rotary actuator to a selected one of said printing drums.

4. An assembly according to claim 3, wherein said power transmitting means further comprises brakes for securing those of said printing drums that are not selected to be actuated.

5. An assembly according to claim 3, wherein said printing drum supporting member supports said printing drums on a circle concentric to said central axial line thereof, and said rotary actuator in a central part thereof.

6. An assembly according to claim 1, wherein said printing drum supporting member driving means comprises a second rotary actuator mounted on said fixed frame, and second power transmitting means for transmitting an output torque of said second rotary actuator to said printing drum supporting member.

7. An assembly according to claim 1, further comprising means for selectively securing said printing drum supporting member at each of indexing angular positions of said printing drum supporting member.

8. An assembly according to claim 7, wherein said printing drum supporting member securing means comprises an engagement groove provided in said printing drum supporting member, an engagement claw provided on said fixed frame, and an actuator for selectively engaging said engagement claw with said engagement groove.

9. An assembly according to claim 7, wherein said printing drum supporting member securing means comprises an engagement groove provided in said printing drum supporting member, a ratchet claw provided on said fixed frame, and springing means biasing said ratchet claw into engagement with said engagement groove.

10. An assembly according to claim 7, wherein said printing drum supporting member securing means comprises a notch provided in said printing drum supporting member, a location pin provided on said fixed frame, and an actuator for selectively engaging said location pin with said notch.

11. An assembly according to claim 1 in combination with a printing device, further comprising;

a press roller associated with a selected one of said printing drums at a corresponding one of indexing angular positions of said printing drum supporting member;

paper feeding means for supplying printing paper to a nip defined between said press roller and said corresponding printing drum at one of said indexing angular positions of said printing drum supporting member;

plate mounting means for mounting a stencil master plate sheet on a different one of said printing drums at one of said indexing angular positions of said printing drum supporting member; and plate ejecting means for ejecting a stencil master plate sheet from said different one of said printing drums at said corresponding indexing angular position of said printing drum supporting member.

12. An assembly according to claim 11 further comprising;

image reading means for reading an original image;

image processing means for color separating said original image read by said image reading means, and producing a plate making image signal for each of a plurality of colors; and plate making means for making a master plate on said stencil master plate sheet according to said plate making image signals supplied from said image processing means.

13. An assembly for supporting a plurality of printing drums for rotative actuation thereof in a multi printing drum stencil printing device, comprising:

a fixed frame;

a printing drum supporting member rotatably supported by said fixed frame around a central axial line of said printing drum supporting member;

a plurality of cylindrical printing drums each adapted to have a stencil master plate sheet mounted around an outer circumferential surface thereof and mounted on said printing drum supporting member so as to be rotatable around an axial line parallel to said central axial line of said printing drum supporting member;

one, and only one first rotary actuator mounted on said fixed frame, said one first rotary actuator having an output shaft;

power transmitting means adapted to selectively and individually engage all of said printing drums with said output shaft of said one first rotary actuator; and printing drum supporting member driving means including a second rotary actuator mounted on said fixed frame, and second power transmitting means for transmitting an output torque of said second rotary actuator to said printing drum supporting member, for effecting an indexing rotary motion of said printing drum supporting member.

* * * * *